United States Patent [19]

Morelli et al.

[11] Patent Number: 4,846,696

[45] Date of Patent: Jul. 11, 1989

[54] MICROWAVE STRIPLINE CONNECTOR

[75] Inventors: John Morelli, Merrimack; Robert Sletten, Bow; Gene Lionetto, Milford, all of N.H.

[73] Assignee: M/A-Com Omni Spectra, Inc., Merrimack, N.H.

[21] Appl. No.: 207,378

[22] Filed: Jun. 15, 1988

[51] Int. Cl.[4] ..... H01R 9/09; H01P 5/00

[52] U.S. Cl. ..... 439/31; 333/260; 333/261

[58] Field of Search ..... 439/11, 13, 29, 30, 439/31, 66, 74, 75, 63, 578, 581; 333/161, 174, 238, 245, 246, 260, 261

[56] References Cited

U.S. PATENT DOCUMENTS 4,208,642 6/1980 Saunders ..... 333/260
4,494,083 1/1985 Josefsson et al. ..... 333/246
4,528,530 7/1985 Ketchen ..... 333/260
4,643,508 2/1987 Schaller ..... 439/31

*Primary Examiner*—Neil Abrams
*Attorney, Agent, or Firm*—Norman P. Soloway

[57] ABSTRACT

A microwave coupler device for connecting a first stripline conductor on one level to a second stripline conductor on another parallel level is described. The device includes a resiliently deformable electrically conductive member (preferably a metal-filled elastomer) for electrically contacting first and second stripline conductors within the device. There is provision for applying a longitudinal compressive force on the first and second stripline conductors compressing the resiliently deformable electrically conductive member between them. In certain embodiments the interconnected striplines can be rotated with respect to one another.

38 Claims, 5 Drawing Sheets

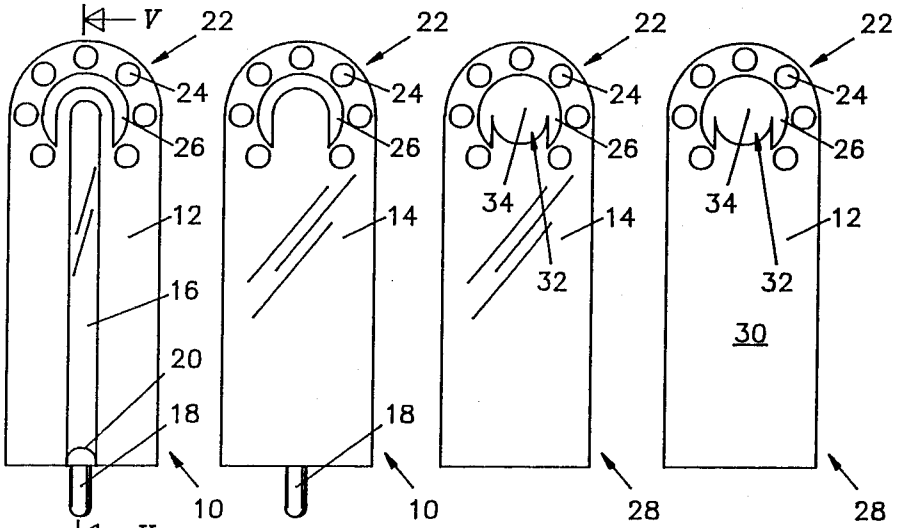
FIG. 1
FIG. 2
FIG. 3
FIG. 4
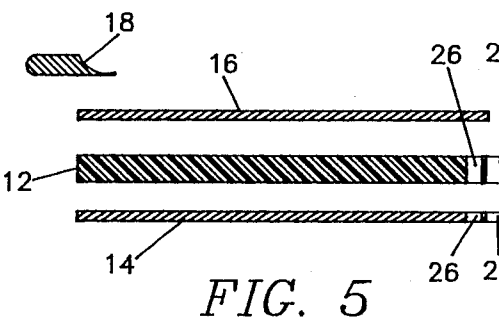
FIG. 5
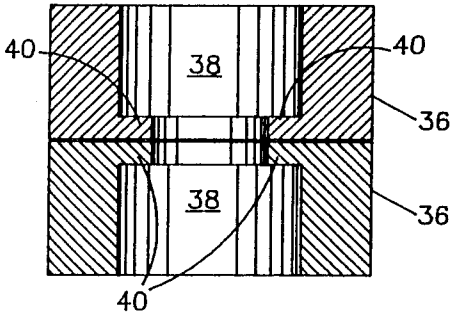
FIG. 7
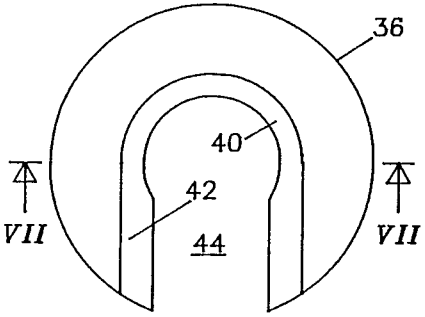
FIG. 6
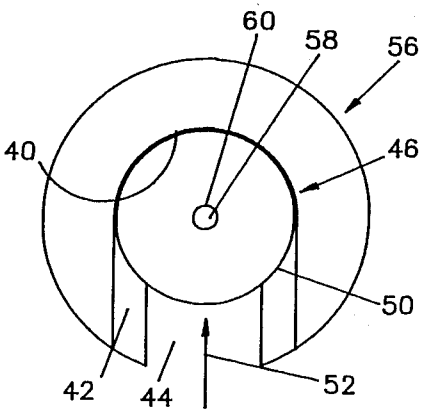
FIG. 8

MICROWAVE STRIPLINE CONNECTOR

BACKGROUND OF THE INVENTION

The present invention relates to electrical connectors, and more particularly to stripline connectors by integrating more than one coupler. Stripline connectors offer good R.F. performance in a much reduced package size than a collection of individual couplers. Lower loss, improved frequency sensitivity and lower Voltage Standing Wave Ratio (VSWR) are a direct result of eliminating excessive line length and multiple mismatches. Stripline multi-connectors also offer a lower cost than a collection of individual couplers.

SUMMARY OF THE INVENTION

The present invention comprises a stripline connector assembly comprising a first stripline conductor on one level and a second stripline conductor on another parallel level, a shield member which preferably is perpendicular to the first and second stripline conductors and connected therebetween and having a longitudinal bore therethrough and radial slots on opposite ends into which the first and second stripline conductors are disposed, respectively, in non-electrical contact therewith. A longitudinal insulator member is disposed within the bore between the opposite ends of the shield member and has a longitudinal bore disposed therethrough communicating between the slots. A resiliently compressible electrically conductive member is disposed within the insulator between the slots and electrically contacts the first and second stripline conductors within respective ones of the slots. Means are provided for applying a longitudinal compressive force on the first and second stripline conductors compressing the conductive member between them.

In the preferred embodiment, the shield member is comprised of first and second portions longitudinally disposed next to one another on the insulator member whereby the first and second portions can be rotated with respect to one another about the insulator member. Moreover, the first and second portions of the shield preferably have keyhole-shaped slots longitudinally disposed along one side and the insulator member is cylindrical and of a resiliently compressible material whereby the first and second portions can be assembled onto the insulator member by snap pressing the insulator member into the keyhole-shaped slots.

The preferred means for applying a longitudinal compressive force on the first and second stripline conductors comprises, a first housing member of an electrically conductive shielding material disposed over the tubular shield member and perpendicular thereto on one of the opposite ends; a second housing member of an electrically conductive shielding material disposed over the tubular shield member and perpendicular thereto on the other of the opposite ends; and, means for fastening the first and second housing member together under a compressive force.

Again in the preferred embodiment, the first and second housing members have slots in facing surfaces thereof for receiving the first and second stripline conductors, respectively, and the facing surfaces are in contact with one another.

Preferably, each housing member also has a coaxial type connector fastened to the outside thereof with a shield portion thereof in electrical contact with its housing member and an inner contact portion in electrical contact with the stripline conductors.

DESCRIPTION OF THE DRAWINGS

FIG. 1 is a plan view of the stripline side of one of the internal conductor members of the present invention.

FIG. 2 is a plan view of the opposite side of the internal conductor member of FIG. 1.

FIG. 3 is a plan view of one side of the other of the internal conductor members employed in the present invention.

FIG. 4 is a plan view of the other side of the internal conductor member of FIG. 3.

FIG. 5 is an exploded side view of the internal conductor member of FIG. 1.

FIG. 6 is a top view of the stacked shield portions of the conductor core of the present invention prior to having the central insulator snapped therein.

FIG. 7 is a cutaway view through the stacked shield portions of FIG. 6 in the plane VII—VII.

FIG. 8 is a top view showing the stacked shield portions of FIG. 6 with the central insulator snapped in place.

DESCRIPTION OF THE PREFERRED EMBODIMENT

Figures 9, 10, 11, 12, 13, 14, 15:
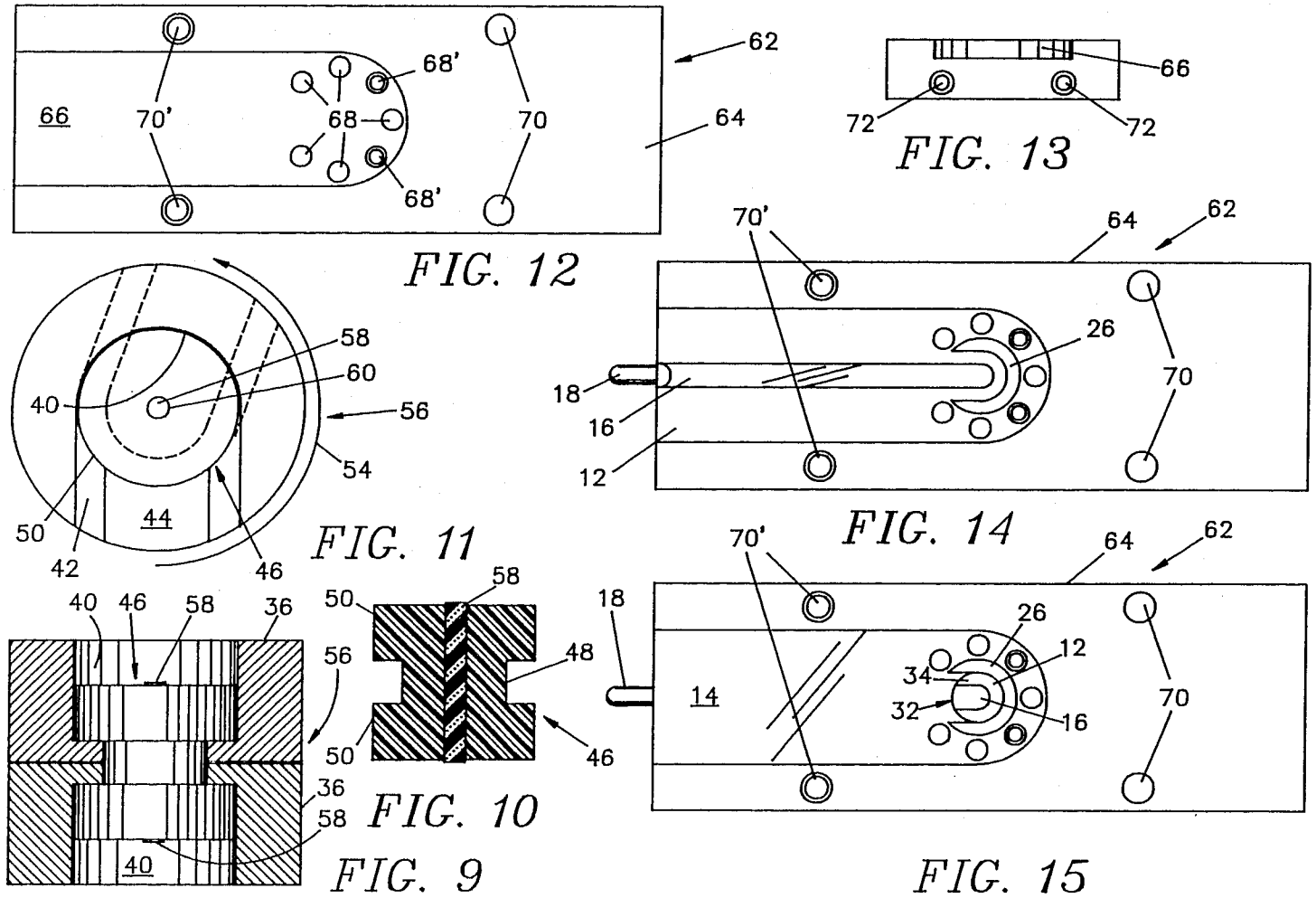
FIG. 9 is a partially cutaway side view showing the stacked shield portions of FIG. 7 with the central insulator snapped in place.
FIG. 10 is a cutaway elevation through the center of the central insulator.
FIG. 11 is a plan view of the assembled shield portions and insulator of FIG. 8 showing the manner in which the shield portions are rotated with respect to one another about the central insulator to lock the assembly together.
FIG. 12 is a plan view of one half of the housing of the present invention which is composed of identical halves.
FIG. 13 is an end view of the housing of FIG. 12 from the slot end.
FIG. 14 is a plan view of the housing of FIG. 12 with the internal conductor member of FIGS. 1 and 2 disposed in the slot thereof.
FIG. 15 is a plan view of the partially assembled connector of the present invention of FIG. 14 with the internal conductor member of FIGS. 3 and 4 positioned in the slot.
Figure 17:
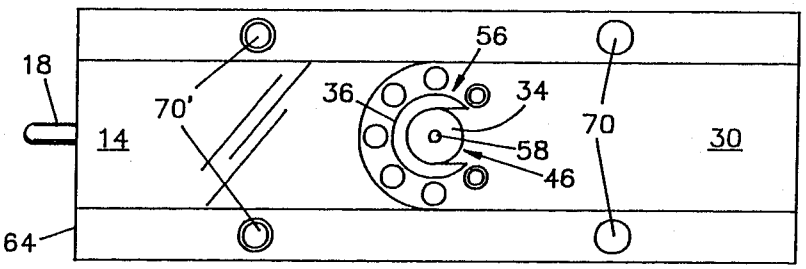
FIG. 17 is a plan view of the partially assembled conductor of the present invention with a second internal conductor member as in FIGS. 3 and 4 positioned thereon.

Because of the size of the parts involved and the thinness of some of the metal layers due to their being formed by plating, the drawings which accompany the description hereinafter are not necessarily to scale. Those skilled in the art will readily recognize those areas in which certain portions are not to scale so that drawings thereof could be made without line overlap.

The present invention consists of three major components—a pair of internal conductors each composed of a pair of conductor members, a conductor core for interconnecting the conductors and a housing for containing the above-described components. The first internal conductor member 10 is shown in FIGS. 1 and 2 from opposed sides. The first internal conductor member 10 is also shown in a cutaway exploded side view longitudinally through the center thereof in FIG. 5. Member 10 comprises a strip of insulating substrate material 12 of any of a number of types well known to those skilled in the art. Such materials are generally available with a thin layer of copper already plated on the two surfaces thereof which can have undesired portions removed by various techniques such as etching, and the like for making printed circuit boards, etc. The first internal conductor member 10 has the copper 14 on one side fully intact and the copper on the opposite side removed except for a stripline conductor 16 as is known in the art. A gold-plated contact 18 extends outward from the end of the stripline conductor 16 and is fastened thereto as with solder 20, or the like. It will be noted that the member 10 is generally rectangular in shape and with the end 22 opposite the contact 18 being semicircular. It is not necessary that end 22 be semicircular; however, this is the preferred embodiment for reasons which will become apparent shortly. There are a plurality of equally spaced bores 24 circularly disposed adjacent the end 22 and surrounding an arcuate opening 26 which forms a tongue 27 near the end of the stripline conductor 16.

The second internal conductor member 28 as shown in FIGS. 3 and 4 is shaped substantially identically to the first member 10 so as to fit within a common shaped slot as will be seen shortly. Second member 28 has the copper 14 on one side intact with the copper non-existent or removed from the opposite side as shown in FIG. 4. In use, the non-conductive surface 30 is placed against the stripline conductor 16 such that the stripline conductor 16 is disposed between the parallel spaced copper surfaces 14 acting as shields about the conductor 16 with the insulating substrate material 12 disposed therebetween as is generally known in the art. As shown in FIGS. 3 and 4, the second member 28 has a composite opening 32 therethrough composed of a matching arcuate opening 26 having a smaller circular opening 34 concentrically located therein and partially defined by tongue 29.

Turning now to FIGS. 6–11, the conductor core portion will now be described. As shown in FIGS. 6 and 7, there are a pair of metallic shield portions 36 which are cylindrical in shape and having a concentric cylindrical bore 38 therethrough. The diameter of the shield 36 is the same as the outer diameter of the arcuate holes 26 in the two conductor elements 10 and 28. There is a circumferential ridge 40 adjacent one end of the bore 38 in each of the shield portions 36. The shield portions 36 are initially stacked together with the ridges 40 juxtaposed against one another. A first slot 42 is of width equal to the diameter of the cylindrical bore 38 as well as the width of the tongues 27 and 29. This slot communicates with the bore 38 through one side of the shield portions 36. A second slot 44 communicates with the cylindrical bore 38 through the circumferential ridges 40, being of a diameter slightly less than that of the circumferential ridge 40 such that a keyhole type slot is formed. As shown in FIGS. 8 and 10 there is a central insulator 46 of an insulating material such as that sold under the trademark Teflon (®). The central insulator 46 is shaped like a spool, having a central cylindrical portion 48 on the ends of a diameter equal to or slightly less than the cylindrical bore 38. As thus configured, the central insulator 46 can be snapped through the slots 42, 48 as indicated by the arrow 52 in FIG. 8 to snap into the cylindrical bore 38. Thereafter, the shield portions 36 can be rotated about the central insulator 46, as indicated by the arrow 54 in FIG. 11. This rotation serves two purposes. First, subsequent to rotation, the components 36, 36, 46 are not easily separated. Second, through rotation, the slots 42, 44 can be placed in correct positional alignment for the particular connector as will be understood from further descriptions hereinafter. It should be noted at this point that the swiveling conductor core assembly, generally indicated as 56, is a preferred embodiment of the present invention and could also be made in a non-swiveling configuration within the scope and spirit of the invention.

Conductor core assembly 56 includes a concentrically disposed conductor 58. Conductor 58 is disposed within a circular bore 60 provided in the central insulator 46 for the purpose. The conductor 58 is slightly longer than the length of the bore so as to extend outward from the ends of the central insulator 46 a slight amount. The conductor 58 is of a resiliently deformable electrically conductive material which, in the preferred embodiment, comprises a metal-filled elastomer. Electrically conductive metal-filled elastomers are available commercially from a variety of sources including Chomerics, Inc. which company offers a variety of silver, silver/copper, silver/aluminum and silver/glass filled silicone and fluorosilicone materials. Alternatively, conductor 58 may comprise a metal member coated at its ends with a metal-filled elastomer.

Turning now to FIGS. 12 and 13, one of the housing portions 62 for a straight-through connector made in accordance with the present invention is shown. Two such housing portions 62 are employed and, as will be seen, the two housing portions 62 are sized and shaped to fit together in 180° facing relationship. Each housing portion 62 comprises a rectangular block of aluminum 64 having a slot 66 longitudinally formed in one surface thereof between an end and the middle of the block 64. The slot 66 is shaped identically to the conductor members 10, 28 and is a depth equal to the thickness of the members 10, 28 in combination. A plurality of bores 68 are provided through the block 64 within the slot 66 to align with the bores 24 of the members 10, 28 when they are disposed within the slots 66. A pair of opposed bores 70 are disposed adjacent the edges of the block 64 adjacent either end. One pair of the bores 70, indicated as 70', is threaded while the other pair is a clearance fit.

Similarly, one opposed pair of the bores 68, indicated as 68', is threaded while the remaining bores are clearance fits. Additionally, the end of the block adjacent the opening to the slot 62 has a pair of opposed threaded bores 72 therein.

Figure 16:
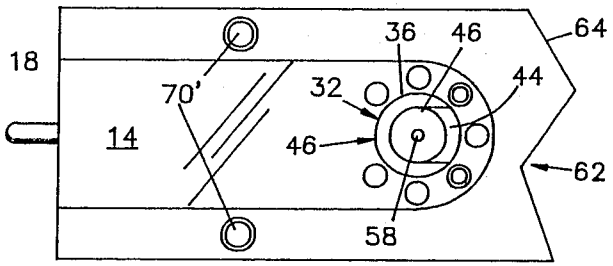
FIG. 16 is a partial plan view of the partially assembled connector of FIG. 15 with the assembled conductor core positioned within the conductor members.
Figure 18:
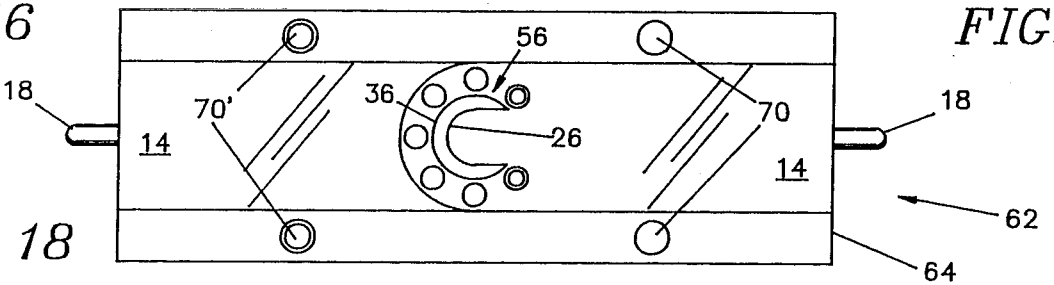
FIG. 18 is a plan view of the partially assembled connector of FIG. 17 with a second conducting member as in FIGS. 1 and 2 added thereto.
Figure 19:
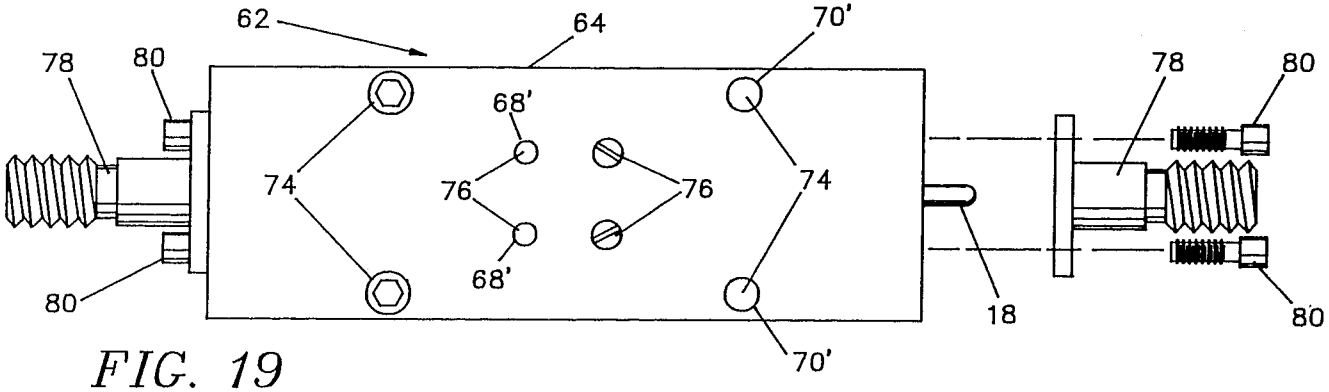
FIG. 19 is a partially exploded view of the fully assembled connector of the present invention with a second housing member as in FIG. 12 positioned over the second conducting members of FIG. 18 and coaxial connectors attached thereto.
Figure 20:
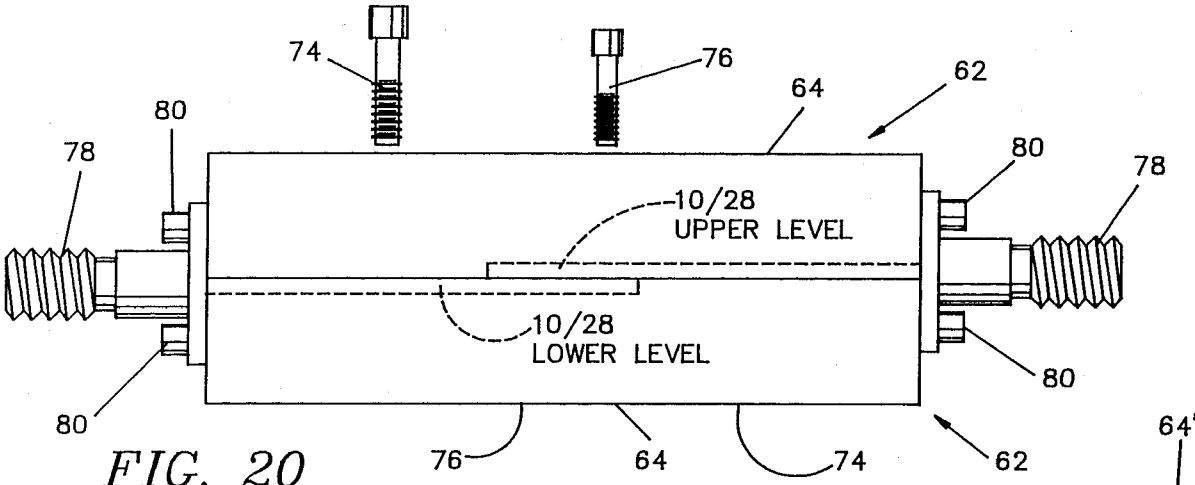
FIG. 20 is a side view of the assembled connector of FIG. 19.

The manner of assembly of the foregoing components into the connector of the present invention is shown in FIGS. 14–21. A first internal conductor member 10 is first disposed in the slot 66 with the stripline conductor 16 facing outward as shown in FIG. 14. A second internal conductor member 28 is then disposed in the slot 66 over the first member 10 with the copper 14 facing out as shown in FIG. 15. The conductor core assembly 56 is then inserted into the aligned arcuate openings 26 and composite opening 32 as shown in FIG. 16. It should be appreciated that the tip of the stripline conductor 16 passes into the first slot 42 of the lower shield portion 36 where it is disposed under the conductor 58 to be contacted by the tip thereof. Another second internal conductor member 28 is then positioned over the conductor core assembly 56 oriented 180° with respect to the first and second member 10, 28 previously inserted into the slot 66 and in parallel therewith. This second internal conductor member 28 has the copper 14 down in contact with the copper 14 of the other second member 28. Note also that to accomplish this alignment, the slots 32, 44 of the one shield portion 36 are disposed 180° with respect to the slots 42, 44 of the other shield portion of the conductor core assembly 56. The swiveling arrangement of the shield portions 36 about the central insulator 46 of the preferred embodiment, as previously described, makes this alignment quite easy. Another first internal conductor member 10 is then placed over the second member 28 as shown in FIG. 18 with its stripline conductor 16 facing the conductor 58 and disposed within the slot 42 to contact the other tip of conductor 58 as shown in FIG. 18. A second housing portion 62 is then placed over the above-described assembled components with upper members 10, 28 within the slot 66 thereof which, for such purpose, is oriented 180° with respect to the lower slot 66 (or to the right as the figure is viewed). Assembly is completed by threading bolts 74 through the clearance bores 68 and into the threaded bores 68' and bolts 76 through the clearance bores 70 and bores 24 into the threaded bores 70'. Conventional coaxial connectors 78 are fit over the gold-plated contacts 18 and held in place with bolts 80 passing through bores provided for the purpose in the connector 78 and into the threaded bores 72.

Figure 21:
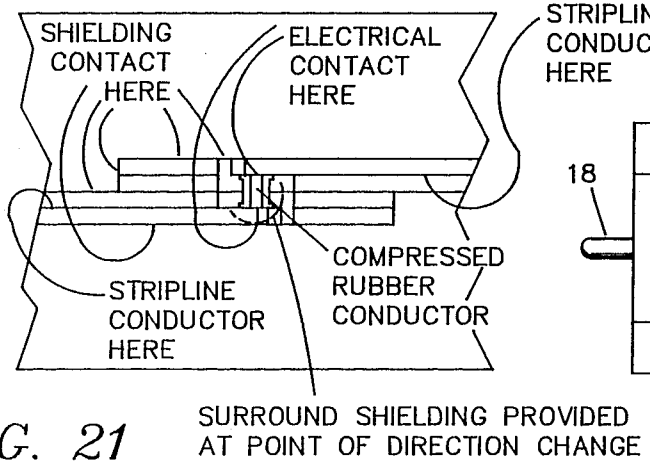
FIG. 21 is a cutaway view through the central portion of the assembled connector of FIG. 20 showing the manner in which shielded electrical contact is accomplished.

As can best be understood from the labeled and uncrosshatched drawing of FIG. 21 (which was so drawn for the purpose to permit understanding without confusing crosshatching), the copper 14 in contact with the housing portions 62 and the shield portions 36 forms a continuous shield between the gold-plated contacts 18 on one end and the central insulator 46 in the center. They are tightly held together in electrical contact without unshielded gaps by the compressive forces of the bolts 74, 76. Similarly, a solid and positive electrical path along the stripline conductors 16 between the gold-plated contacts 18 is affected by the resiliently compressible conductor 58 which is compressed between the tips of stripline conductor 16 by the compressive force of the bolts 76 in particular.

Figure 22:
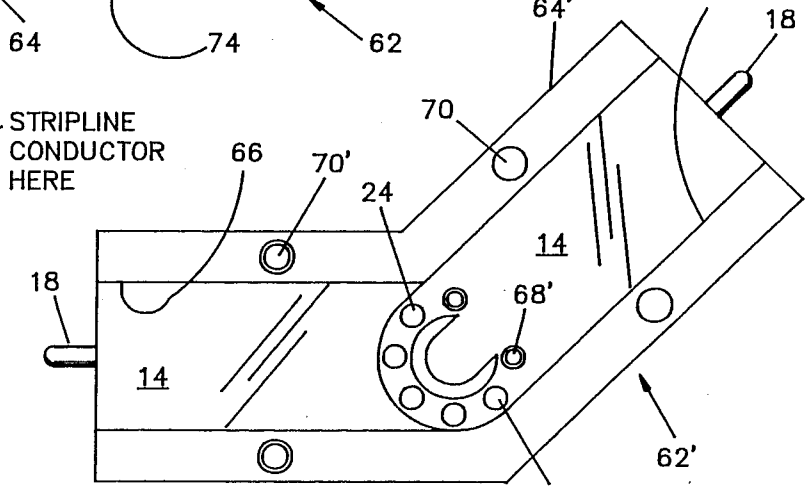
FIG. 22 is a plan view of an alternate embodiment of the present invention wherein the two conductor member portions meet at the conductor core in a 135° angle.

A first alternate embodiment of the present invention is shown in FIG. 22 wherein the conductor members 10, 28 on one end meet the similar members 10, 28 on the other end at an angle instead of at 180° as in the previous embodiment. In the embodiment as shown, the bores 24 are radially spaced at 45° such that a connector meeting at 135° and 90° is easily made without modifying the members 10, 28. Other angular orientations could, of course, be made by radially spacing the bores 24 approximately, as will be readily appreciated by those skilled in the art without the necessity of detailed explanation. If a swiveling conductor core assembly 56 is applied as in the preferred embodiment, the conductor core assembly 56 is adaptable to any angular orientation.

Figure 23:
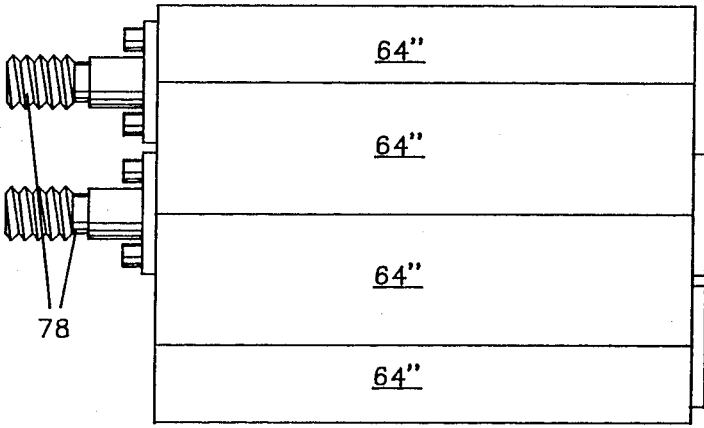
FIG. 23 is a side view of an assembled connector according to the present invention in an alternate embodiment wherein two connections are affected in the same housing.
Figure 24:
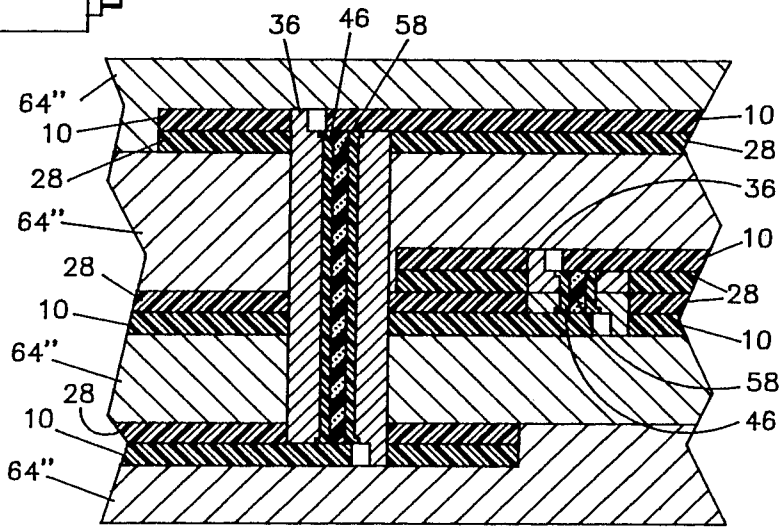
FIG. 24 is a cutaway view through the central portion of the connector of FIG. 23.

A further aspect of the present invention is shown in FIGS. 23 and 24 wherein multiple connectors are assembled in a single housing. Thus, it will be appreciated that the present invention can be employed to connect a single circuit from one level to a circuit contained within a housing on a different level; or, to connect a stripline conductor on one level to a stripline conductor on another parallel layer. As can be seen, in this embodiment, the coaxial connectors 78 at the top and bottom are interconnected while the middle coaxial connectors 78 are also interconnected. As those skilled in the art will appreciate without additional description thereof, the attributes as hereinbefore described can be combined to create, for example, various connectors having multiple inputs and outputs and angular orientations from layer to layer.

Wherefore, having thus described the invention, what is claimed is:

1. In microwave coupler apparatus containing a housing including a first stripline conductor on one level and a second stripline conductor on another parallel level, the improvement comprising:

(a) a conductive shield member perpendicular to the first and second stripline conductors and connected therebetween, said shield member having a longitudinal bore therethrough and openings on opposite ends into which the first and second stripline conductors are disposed, respectively, in non-electrical contact therewith;

(b) a longitudinal insulator member disposed within said bore between said opposite ends and having a longitudinal passage disposed therethrough communicating between said openings;

(c) a resiliently deformable electrically conductive member disposed within said passage between said openings and electrically contacting the first and second stripline conductors within respective ones of said openings; and, (d) means for applying a longitudinal compressive force on the first and second stripline conductors compressing said conductive member between them.

2. The apparatus of claim 1 wherein:

said shield member is comprised of first and second portions longitudinally disposed next to one another on said insulator member whereby said first and second portions can be rotated with respect to one another about said insulator member.

3. The apparatus of claim 2 wherein:

(a) said first and second portions have keyhole-shaped slots longitudinally disposed along one side; and, (b) said insulator member is cylindrical and of a resiliently compressible material whereby said first and second portions can be assembled onto said insulator member by snap pressing said insulator member into said keyhole-shaped slots.

4. The apparatus of claim 1 wherein:

said conductive member is formed of a metal-filled elastomer.

5. The apparatus of claim 1 wherein said means for applying a longitudinal compressive force on the first and second stripline conductors comprises:

(a) a first housing member of an electrically conductive shielding material disposed over said shield member and perpendicular thereto on one of said opposite ends;

(b) a second housing member of an electrically conductive shielding material disposed over said shield member and perpendicular thereto on the other of said opposite ends; and, (c) means for fastening said first and second housing members together under a compressive force.

6. The apparatus of claim 5 wherein:

said first housing member and said second housing member have slots in facing surfaces thereof for receiving the first and second stripline conductors, respectively, and said facing surfaces are in contact with one another.

7. The apparatus of claim 6 wherein:

said first housing member has a first coaxial connector fastened to the outside thereof with a shield portion thereof in electrical contact with said first housing member and an inner contact portion in electrical contact with one of the first and second stripline conductors.

8. The apparatus of claim 6 wherein:

said second housing member has a second coaxial connector fastened to the outside thereof with a shield portion thereof in electrical contact with said second housing member and an inner contact portion in electrical contact with the other of the first and second stripline conductors.

9. In apparatus for connecting a microwave device on one level of an electronic circuit to another parallel level of the circuit with stripline conductors for microwave applications, the improvement comprising:

(a) a first stripline conductor on the one level;

(b) a second stripline conductor on the other level;

(c) a tubular shield member perpendicular to said first and second stripline conductors and connected therebetween, said shield member having a longitudinal first bore therethrough and radial slots on opposite ends into which said first and second stripline conductors are disposed, respectively, in non-electrical contact therewith;

(d) a longitudinal insulator member disposed within said first bore between said opposite ends and having a longitudinal second bore disposed therethrough communicating between said slots;

(e) a resiliently deformable electrically conductive member disposed within said second bore between said slots and electrically contacting said first and second stripline conductors within respective ones of said slots;

(f) a first coaxial connector having a shield portion thereof in electrical contact with said tubular shield member and an inner contact portion in electrical contact with said first stripline conductor; and, (g) means for applying a longitudinal compressive force on said first and second stripline conductors compressing said conductive member between them.

10. The apparatus of claim 9 wherein:

said tubular shield member is comprised of first and second portions longitudinally disposed next to one another on said insulator member whereby said first and second portions can be rotated with respect to one another about said insulator member.

11. The apparatus of claim 10 wherein:

(a) said first and second portions have keyhole-shaped slots longitudinally disposed along one side; and, (b) said insulator member is cylindrical and of a resiliently compressible material whereby said first and second portions can be assembled onto said insulator member by snap pressing said insulator member into said keyhole-shaped slots.

12. The apparatus of claim 9 wherein:

said conductive member is formed of a metal-filled elastomer.

13. The apparatus of claim 9 wherein said means for applying a longitudinal compressive force on said first and second stripline conductors comprises:

(a) a first housing member of an electrically conductive shielding material disposed over said tubular shield member and perpendicular thereto on one of said opposite ends;

(b) a second housing member of an electrically conductive shielding material disposed over said tubular shield member and perpendicular thereto on the other of said opposite ends; and, (c) means for fastening said first and second housing members together under a compressive force.

14. The apparatus of claim 13 wherein:

said first housing member and said second housing member have slots in facing surfaces thereof for receiving said first and second stripline conductors, respectively, and said facing surfaces are in contact with one another.

15. The apparatus of claim 14 wherein:

said first housing member has said first coaxial connector fastened to the outside thereof with said shield portion thereof in electrical contact with said second housing member.

16. The apparatus of claim 15 wherein:

said second housing member has a second coaxial connector fastened to the outside thereof with a shield portion thereof in electrical contact with said second housing member and an inner contact portion in electrical contact with said second stripline conductor.

17. The apparatus of claim 14 wherein said first and second stripline conductors each comprise;

(a) a first internal conductor member comprising a strip of a thin insulative substrate material having an electrically conductive shielding surface on one side and a thin stripline conductive strip on the opposite side;

(b) a second internal conductor member comprising a strip of a thin insulative substrate material having an electrically conductive shielding surface on one side and a non-conductive surface on the opposite side; and wherein, (c) said first and second internal conductor members and said slots in said facing surfaces are substantially identical in shape whereby said first and second internal conductor members can be disposed with said slots in said facing surfaces with said thin stripline conductive strip of said first internal conductor member disposed against said non-conductive surface of said second internal conductor member.

18. The apparatus of claim 17 wherein:

said first and second internal conductor members have concentric arcuate bores therethrough on one end through which said tubular shield member can pass.

19. The apparatus of claim 18 wherein:

said second internal conductor member has a circular bore concentric with said arcuate bore thereof through which said longitudinal insulator member and said compressible electrically conductive member can pass so that said compressible electrically conductive member can contact said thin stripline conductive strip.

20. The apparatus of claim 19 wherein said tubular shield member is comprised of first and second portions longitudinally disposed next to one another on said insulator member whereby said first and second portions can be rotated with respect to one another about said insulator member and wherein additionally:

said first and second internal conductor members have semi-circular ends concentric with said arcuate bores and a plurality of equally radially spaced bores therethrough concentric about said arcuate bores whereby a first pair of said first and second internal conductor members can be angularly aligned with a second pair of said first and second internal conductor members with said radially spaced bores thereof in alignment.

21. The apparatus of claim 20 wherein:

said slots in said facing surfaces of said first housing member and said second housing members have semi-circular ends concentric with said arcuate bores and a plurality of equally radially spaced bores therethrough concentric about said arcuate bores whereby said compressive force can be applied by passing a bolt through at least an aligned one of said radially spaced bores in said first and second housing member and said first and second internal conductor members.

22. The apparatus of claim 21 wherein:

a said equally radially spaced bore in said first housing member is threaded to receive a bolt, and a said aligned equally radially spaced bore in said second housing member is a clearance bore to said bolt whereby said compressive force can be applied by passing said bolt through said clearance bore into threaded engagement with said threaded bore.

23. In apparatus for interconnecting microwave devices, the improvement comprising:

(a) a first stripline conductor disposed on one level;

(b) a second stripline conductor disposed on another level;

(c) a tubular shield member perpendicular to said first and second stripline conductors and connected therebetween, said shield member having a longitudinal first bore therethrough and radial slots on opposite ends into which said first and second stripline conductors are disposed, respectively, in non-electrical contact therewith;

(d) a longitudinal insulator member disposed within said first bore between said opposite ends and having a longitudinal second bore disposed therethrough communicating between said slots;

(e) a resiliently deformable electrically conductive member disposed within said second bore between said slots and electrically contacting said first and second stripline conductors within respective ones of said slots;

(f) a first coaxial connector having a shield portion thereof in electrical contact with said tubular shield member and an inner contact portion in electrical contact with said first stripline conductor;

(g) a second coaxial connector having a shield portion thereof in electrical contact with said tubular shield member and an inner contact portion in electrical contact with said stripline conductor; and, (h) means for applying a longitudinal compressive force on said first and second stripline conductors compressing said conductive member between them.

24. The apparatus of claim 23 wherein:

said tubular shield member is comprised of first and second portions longitudinally disposed next to one another on said insulator member whereby said first and second portions can be rotated with respect to one another about said insulator member.

25. The apparatus of claim 24 wherein:

(a) said first and second portions have keyhole-shaped slots longitudinally disposed along one side; and, (b) said insulator member is cylindrical and of a resiliently compressible material whereby said first and second portions can be assembled onto said insulator member by snap pressing said insulator member into said keyhole-shaped slots.

26. The apparatus of claim 23 wherein:

said conductive member is formed of a metal-filled elastomer.

27. The apparatus of claim 23 wherein said means for applying a longitudinal compressive force on said first and second stripline conductors comprises:

(a) A first housing member of an electrically conductive shielding material disposed over said tubular shield member and perpendicular thereto on one of said opposite ends;

(b) a second housing member of an electrically conductive shielding material disposed over said tubular shield member and perpendicular thereto on the other of said opposite ends; and, (c) means for fastening said first and second housing members together under a compressive force.

28. The apparatus of claim 27 wherein:

said first housing member and said second housing member have slots in facing surfaces thereof for receiving said first and second stripline conductors, respectively, and said facing surfaces are in contact with one another.

29. The apparatus of claim 28 wherein:

(a) said first housing member has said first coaxial connector fastened to the outside thereof with said shield portion thereof in electrical contact with said second housing member; and (b) said second housing member has a second coaxial connector fastened to the outside thereof with a shield portion thereof in electrical contact with said second housing member and an inner contact portion in electrical contact with said stripline conductor.

30. The apparatus of claim 27 wherein said first and second stripline conductors each comprise:

(a) a first internal conductor member comprising a strip of a thin insulative substrate material having an electrically conductive shielding surface on one side and a thin stripline conductive strip on the opposite side;

(b) a second internal conductor member comprising a strip of a thin insulative substrate material having an electrically conductive shielding surface on one side and a non-conductive surface on the opposite side; and wherein, (c) said first and second internal conductor members and said slots in said facing surfaces are substantially identical in shape whereby said first and second internal conductor members can be disposed said slots in said facing surfaces with said thin stripline conductive strip of said first internal conductor member disposed against said non-conductive surface of said second internal conductor member.

31. The apparatus of claim 30 wherein:

said first and second internal conductor members have concentric arcuate bores therethrough on one end through which said tubular shield member can pass.

32. The apparatus of claim 31 wherein:

said second internal conductor member has a circular bore concentric with said arcuate bore thereof through which said longitudinal insulator member and said compressible electrically conductive member can pass so that said compressible electrically conductive member can contact said thin stripline conductive strip.

33. The apparatus of claim 32 wherein said tubular shield member is comprised of first and second portions longitudinally disposed next to one another on said insulator member whereby said first and second portions can be rotated with respect to one another about said insulator member and wherein additionally;

said first and second internal conductor members have semi-circular ends concentric with said arcuate bores and a plurality of equally radially spaced bores therethrough concentric about said arcuate bores whereby a first pair of said first and second internal conductor members can be angularly aligned with a second pair of said first and second internal conductor members with said radially spaced bores thereof in alignment.

34. The apparatus of claim 33 wherein:

said slots in said facing surfaces of said first housing member and said second housing members have semi-circular ends concentric with said arcuate bores and a plurality of equally radially spaced bores therethrough concentric about said arcuate bores whereby said compressive force can be applied by passing a bolt through at least an aligned one of said radially spaced bores in said first and second housing members and said first and second internal conductor members.

35. The apparatus of claim 34 wherein:

a said equally radially spaced bore in said first housing member is threaded to receive a bolt and a said aligned equally radially spaced bore in said second housing member is a clearance bore to said bolt whereby said compressive force can be applied by passing said bolt through said clearance bore into threaded engagement with said threaded bore.

36. The apparatus of claim 1, wherein said resiliently deformable electrically conductive member comprises a metal piece coated at its end with a metal-filled elastomer.

37. The apparatus of claim 9, wherein said resiliently deformable electrically conductive member comprises a metal piece coated at its ends with a metal-filled elastomer.

38. The apparatus of claim 23, wherein said resiliently deformable electrically conductive member comprises a metal piece coated at its ends with a metal-filled elastomer.

* * * * *

UNITED STATES PATENT AND TRADEMARK OFFICE

CERTIFICATE OF CORRECTION

PATENT NO. : 4,846,696

DATED : July 11, 1989

INVENTOR(S) : John MORELLI, Robert SLETTEN, Gene LIONETTO

It is certified that error appears in the above—identified patent and that said Letters Patent is hereby corrected as shown below:

Claim 36, column 12, line 31, delete "end" and insert in place thereof --ends--.

Signed and Sealed this

Twenty-second Day of May, 1990

*Attest:*

HARRY F. MANBECK, JR.

*Attesting Officer*

*Commissioner of Patents and Trademarks*